US009670889B2

(12) United States Patent
Dugad et al.

(10) Patent No.: US 9,670,889 B2
(45) Date of Patent: Jun. 6, 2017

(54) SEALING SYSTEM FOR AN ENGINE

(71) Applicant: DEERE & COMPANY, Moline, IL (US)

(72) Inventors: Arpita Dugad, Indore (IN); Paul M Wynthein, Waterloo, IA (US)

(73) Assignee: DEERE & COMPANY, Moline, IL (US)

( * ) Notice: Subject to any disclaimer, the term of this patent is extended or adjusted under 35 U.S.C. 154(b) by 889 days.

(21) Appl. No.: 14/056,102

(22) Filed: Oct. 17, 2013

(65) Prior Publication Data

US 2015/0107558 A1 Apr. 23, 2015

(51) Int. Cl.
*F02M 55/00* (2006.01)
*F02M 37/00* (2006.01)

(52) U.S. Cl.
CPC ..... *F02M 55/004* (2013.01); *F02M 37/0052* (2013.01); *F02M 55/002* (2013.01); *F02M 55/005* (2013.01); *F02M 2200/16* (2013.01)

(58) Field of Classification Search
CPC .. F02M 55/002; F02M 55/004; F02M 55/005; F02M 37/0052; F02M 2200/16
USPC ..... 123/468, 469, 473
See application file for complete search history.

(56) References Cited

U.S. PATENT DOCUMENTS 6,431,608 B1 * 8/2002 Kato ..... F02M 55/002 285/13
8,177,261 B2 * 5/2012 Guerineau ..... F02M 55/002 123/468
9,279,384 B2 * 3/2016 Dugad ..... F02F 11/002 123/294
2011/0174272 A1 7/2011 Male
2012/0006299 A1 1/2012 Worthington et al.
2012/0038142 A1 * 2/2012 Legrand ..... F02M 55/002 285/14

FOREIGN PATENT DOCUMENTS

DE 4427717 C1 8/1995
FR 2869367 A1 10/2005

OTHER PUBLICATIONS

European Search Report issued in counterpart application No. 14183438.2, dated May 12, 2015 (5 pages).

* cited by examiner

*Primary Examiner* — Hieu T Vo
*Assistant Examiner* — Arnold Castro

(57) ABSTRACT

A sealing system comprising a cylinder head, a coupler, a fuel injection line, and a cap. The coupler is positioned in the cylinder head, and the fuel injection line extends into the coupler so as to at least partially define a fuel leak passageway therebetween. The fuel injection line extends through the cap, and the cap yieldably urges itself into a seated position in which the cap establishes a first sealed connection with the fuel injection line and establishes a second sealed connection with the coupler, so as to block ingress of moisture into the fuel leak passageway. Additionally, the cap allows movement of itself away from the seated position to an unseated position in response to a pressurized leaked fuel, in the fuel leak passageway, so as to allow the pressurized leaked fuel to flow out of the fuel leak passageway.

17 Claims, 6 Drawing Sheets

SEALING SYSTEM FOR AN ENGINE

FIELD OF THE DISCLOSURE

The present disclosure relates to a sealing system for an engine.

SUMMARY OF THE DISCLOSURE

Disclosed is a sealing system comprising a cylinder head, a coupler, a fuel injection line, and a cap. The coupler is positioned in the cylinder head, and the fuel injection line extends into the coupler so as to at least partially define a fuel leak passageway therebetween. The fuel injection line extends through the cap, and the cap yieldably urges itself into a seated position in which the cap establishes a first sealed connection with the fuel injection line and establishes a second sealed connection with the coupler, so as to block ingress of moisture into the fuel leak passageway. Additionally, the cap is adapted to move away from the seated position to an unseated position in response to a pressurized leaked fuel, in the fuel leak passageway, so as to allow the pressurized leaked fuel to flow out of the fuel leak passageway.

By using the cap to prevent the ingress of moisture from the outside environment, rust is less likely to form and block the fuel leak passageway. Otherwise, if the fuel leak passageway did happen to become blocked, as the result of rust, then cracking of the cylinder head could occur. Ultimately, via the disclosed sealing system, the cap provides significant resistance to the ingress of moisture from the outside environment (i.e., rust prevention), but minimal resistance to the egress of leaked fuel to the outside environment (i.e., fuel leak passageway to the outside environment).

BRIEF DESCRIPTION OF THE DRAWINGS

The detailed description of the drawings refers to the accompanying figures in which.

DETAILED DESCRIPTION OF THE DRAWINGS

Figure 1:
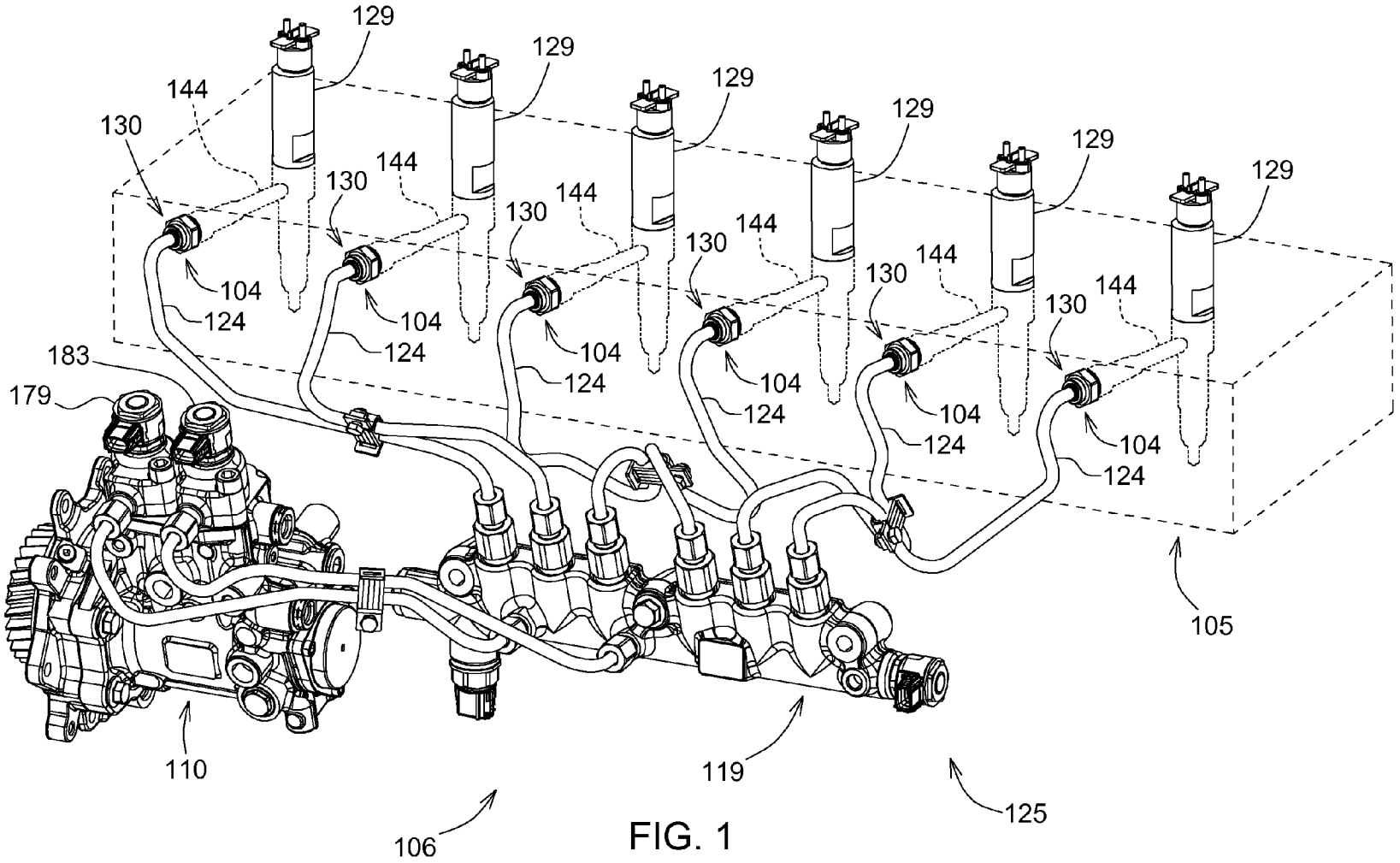
FIG. 1. is a perspective view of a fuel system of an engine, the view further showing a sealing system.

Referring to FIG. 1, there is shown a schematic illustration of an engine 106 for providing power to a variety of machines, including on-highway trucks, construction vehicles, marine vessels, stationary generators, automobiles, agricultural vehicles, and recreation vehicles. The engine 106 may be any kind of engine that produces an exhaust gas, such as, for example, an internal combustion engine, such as a gasoline engine; a diesel engine; a gaseous fuel burning engine, such as a natural gas engine; or any other kind of exhaust gas producing engine. Further, the engine 106 may be of any size, with any number cylinders (not shown), and in any configuration (e.g., "V," inline, and radial). And the engine 106 may include various sensors, such as temperature sensors, pressure sensors, and mass flow sensors. The engine control unit (ECU), not shown, is the brain or the master controller of the engine 106, and its functions include controlling a fuel system 125 and providing the operator or technician diagnostic information.

A gear train (not shown) of the engine 106 drives a high pressure fuel pump 110, such as a Denso fuel pump. During operation, the fuel pump 110 delivers pressurized fuel to a common rail 119, assuming that at least one of selective control valves 179, 183 is open. The common rail 119 acts as an accumulator for maintaining a constant fuel pressure in a plurality of fuel injection line 124. Further, the common rail 119 provides a leak off location; allows for the fuel pump 110 to have just one or two outlets, rather than six (one for each of a plurality of fuel injectors 129); and acts as an accumulator for maintaining a constant pressure in the fuel system 125.

Next, the injection line 124 route the fuel from the common rail 119 to the fuel injectors 129, which are calibrated so as to discharge a required amount of fuel, at a required time, to the combustion chambers (not shown). To do this, the fuel injectors 129 cooperate with a controller, such as the ECU, for example. Among other things, the fuel system 125 provides variable timing control for improved emissions and better control at the start of fuel injection for improved starting.

Referring to FIGS. 2-5, there is shown a sealing system 104 including a cylinder head 105, a coupler 138, the injection line 124, and a cap 130. The coupler 138 is positioned in the cylinder head 105, and the injection line 124 extends into the coupler 138 so as to at least partially define a fuel leak passageway 142. therebetween. The injection line 124 extends through the cap 130, and the cap 130 yieldably urges itself into a seated position in which the cap 130 establishes a first sealed connection 180 with the injection line 124 and establishes a second sealed connection 178 with the coupler 138, so as to block ingress of moisture (see the arrows and droplets 148 in FIG. 4) into the fuel leak passageway 142. Additionally, the cap 130 allows movement of itself away from the seated position to an unseated position in response to a pressurized leaked fuel (see the arrows and droplets 160 in FIG. 5), in the fuel leak passageway 142, so as to allow the pressurized leaked fuel to flow out thereof. The unseated position may be a position where the cap 130 is unseated only partially about a circumference thereof, or a position where the cap is unseated about an entire circumference thereof.

Without the cap 130, significant amounts of moisture (e.g., from a power washer) could accumulate in the fuel leak passageway 142 and cause the formation of rust on, for example, a side feed tube 144, the side feed tube 144 being positioned in the cylinder head 105 and downstream of the injection line 124. The formation of rust could block the egress of fuel from the fuel leak passageway 142, and potentially lead to the development of cracks in the cylinder head 105, a phenomenon known as cylinder head structural failure.

The aforementioned issues are avoided, however, because as discussed, the cap 130 blocks the ingress of moisture when in the seated position—thereby preventing the formation of rust—and also allows the egress of leaked fuel when in the unseated position-thereby allowing leaked fuel to flow through the fuel leak passageway 142. Such an arrangement results in minimal resistance to the egress of leaked fuel to the outside environment, but significant resistance to the ingress of moisture from the outside environment.

As illustrated, the injection line 124 is sandwiched between the coupler 138 and the side feed tube 144, and the side feed tube 144 is sandwiched between the injection line 124 and the cylinder head 105. The side feed tube 144 extends through an o-ring 143. The cylinder head 105 and the side feed tube 144 define a first portion 153 of the fuel leak passageway 142 therebetween. In the embodiment shown, the first portion 153 is partially defined by the o-ring 143. The side feed tube 144 and the coupler 138 define a second portion 155 of the fuel leak passageway 142 therebetween, and the injection line 124 and the coupler 138 define a third portion 157 of the fuel leak passageway 142 therebetween. The first portion 153 is positioned upstream of the second portion 155, and the second portion 155 is positioned upstream of the third portion 157. The first, second, and third portions 153, 155, 157 allow the leaked fuel to flow therethrough and past the cap 130 when it is in the unseated position.

Figure 3:
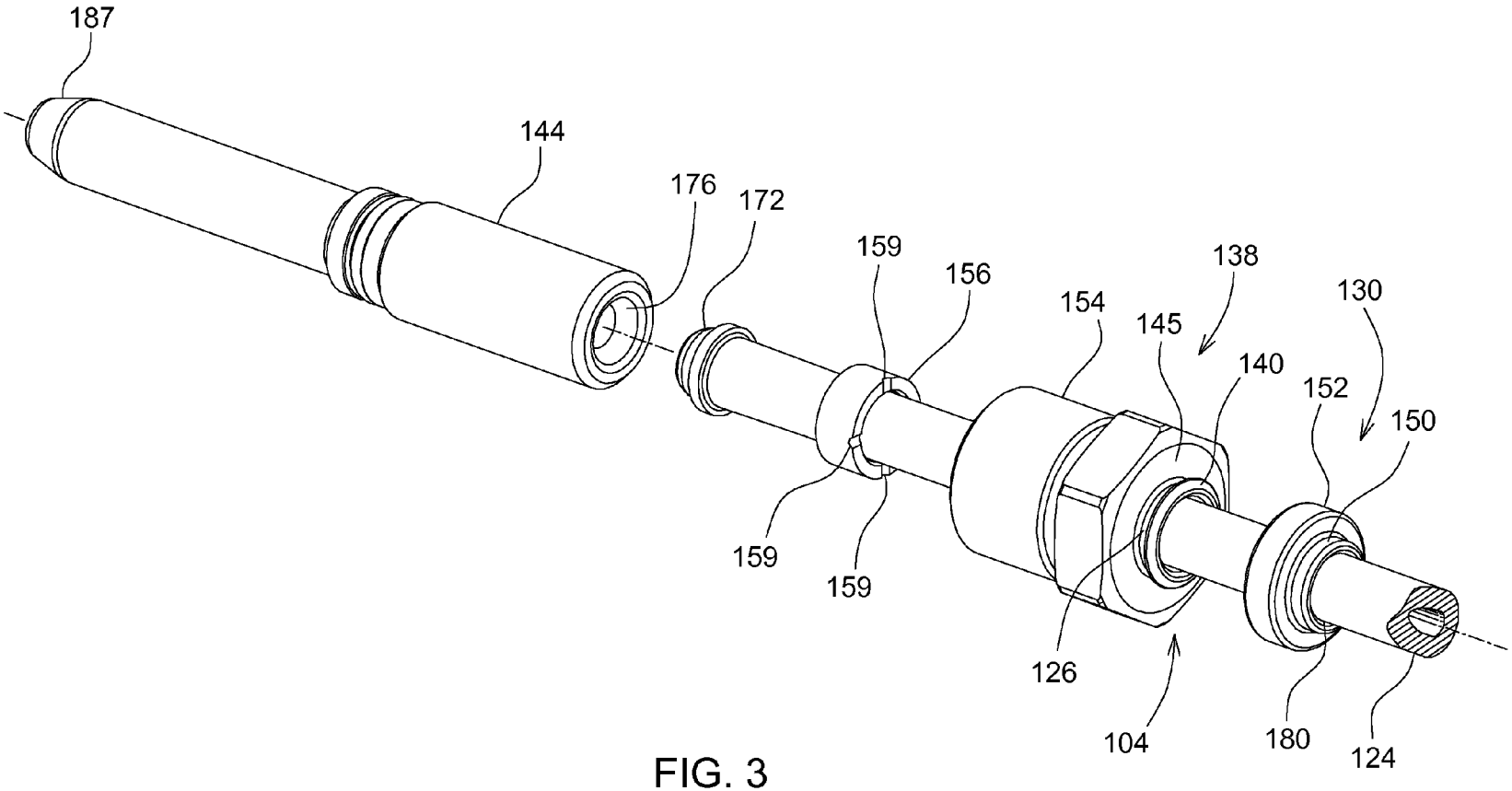
FIG. 3 is an exploded perspective view of the sealing system, showing the side feed tube, the fuel injection line, and the cap.
Figure 4:
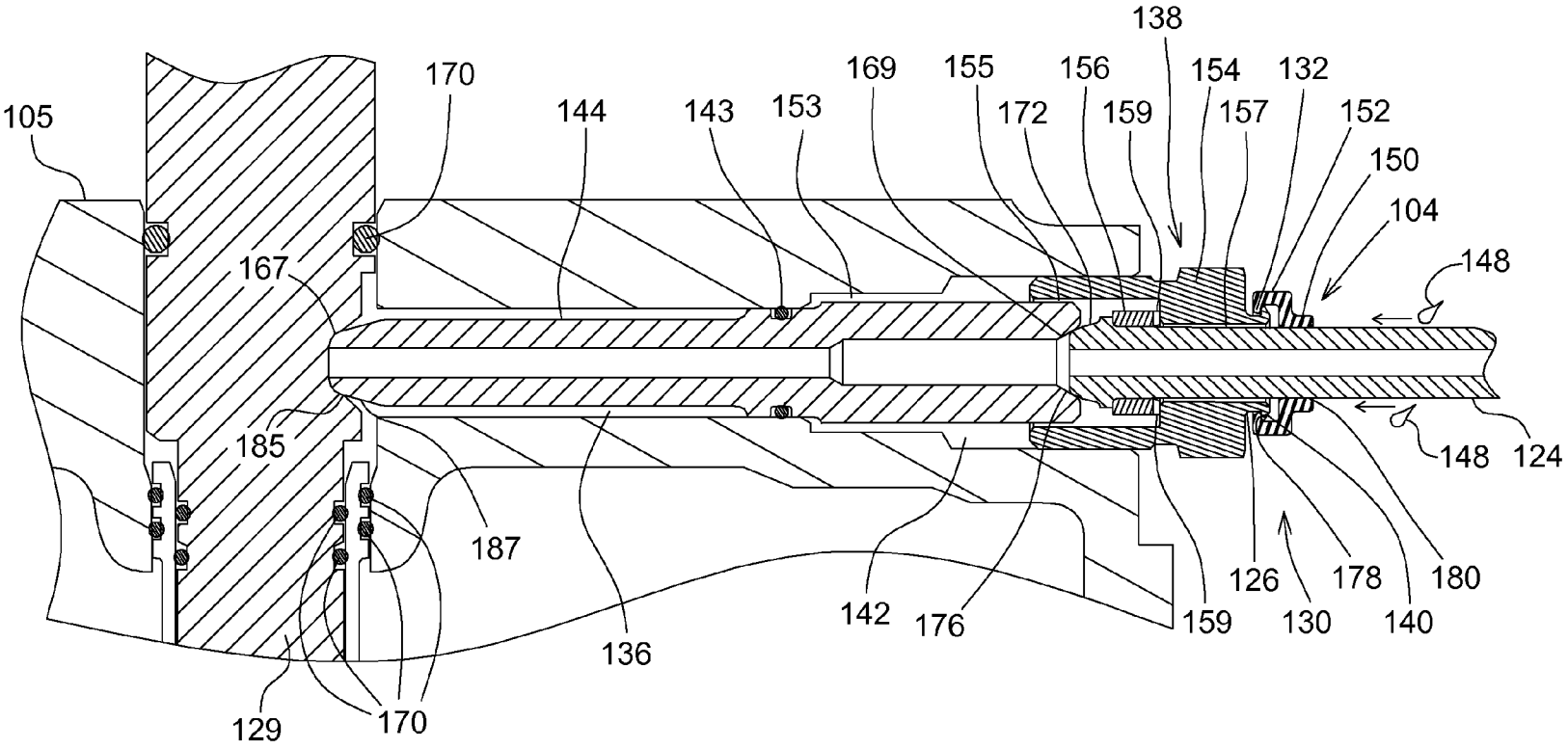
FIG. 4 is a sectional view of the sealing system taken along line 4-4 of FIG. 2, showing the cap in a seated position, blocking the ingress of moisture.
Figure 5:
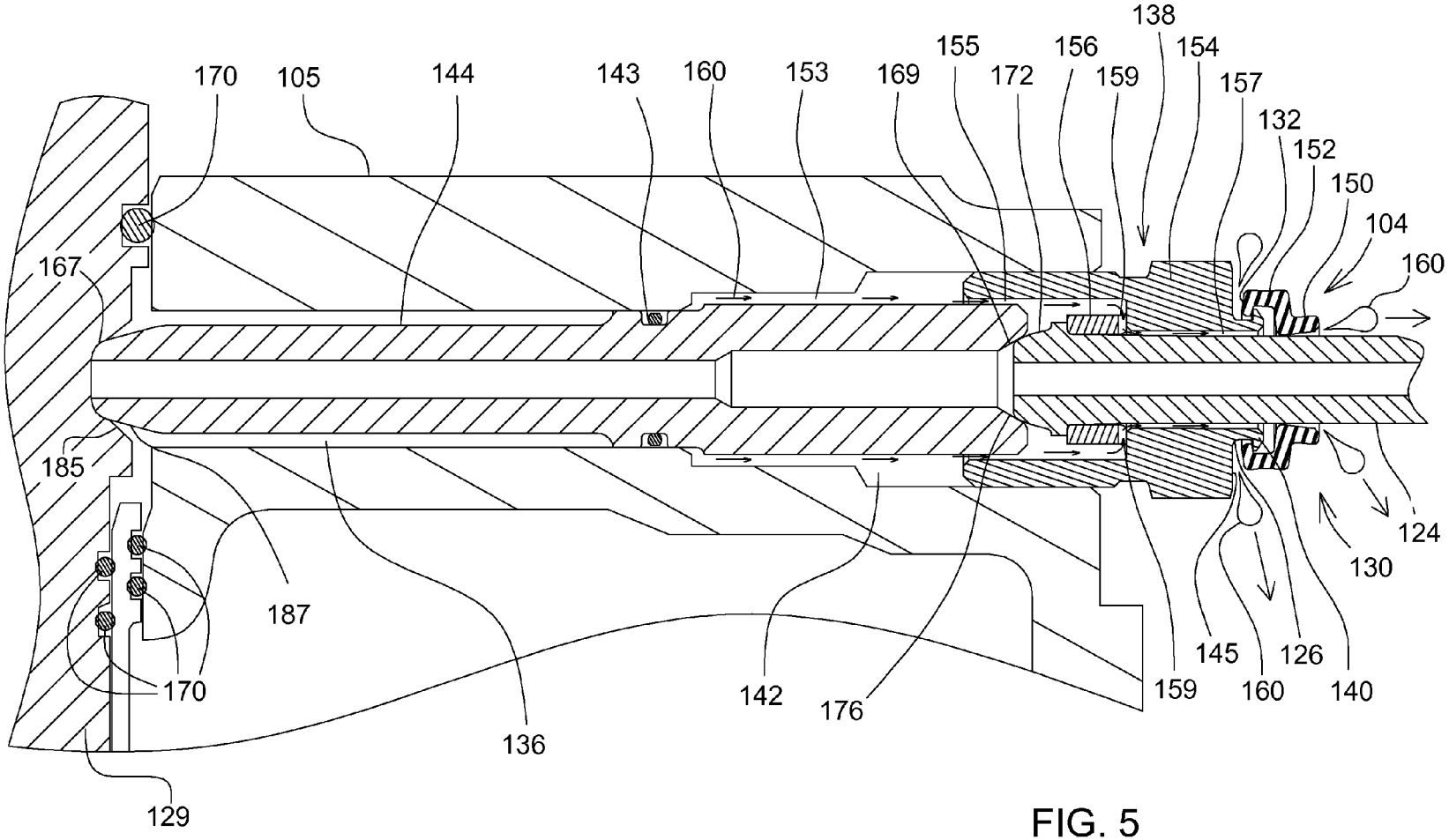
FIG. 5 is a sectional view of the sealing system taken along lines 5-5 of FIG. 2, showing the cap in an unseated position, allowing the egress of fuel to the outside environment.

Referring to FIGS. 3-5, the leaked fuel flowing through the fuel leak passageway 142 emanates from the first junction 169 (see the arrows and droplets 160 in FIG. 5), positioned between the side feed tube 144 and the injection line 124. The side feed tube 144 has an inwardly and conically shaped end 176 (i.e., hallow portion) for accommodating an outwardly and conically shaped end 172 (i.e., solid portion) of the injection line 124, so as to form the first junction 169. As shown, the first junction 169 forms between the injection line 124 and the side feed tube 144 when the conically shaped ends 172, 176 are joined, thereby providing a circumferential sealing effect. There can be a risk of high pressure fuel leaks at the first junction 169 due to improper sealing (i.e., insufficient torque or axial force), and in such cases, high pressure fuel leaks into the fuel leak passageway 142. The discharge or leakage of fuel, from the engine 106 and specifically from the fuel leak passageway 142, indicates to the operator of the engine 106 that a service operation may be necessary.

In addition, a second junction 167 is positioned between the side feed tube 144 and the fuel injector 129. The fuel injector 129 has an inwardly and conically shaped end 185 (i.e., hallow portion) for accommodating an outwardly and conically shaped end 187 (i.e., solid portion) of the side feed tube 144. As shown, the second junction 167 forms between the fuel injector 129 and the side feed tube 144 when the conically shaped ends 185, 187 are joined, thereby providing a circumferential sealing effect. Every time the fuel injector 129 is actuated and the plunger pushes fuel to a tip of the fuel injector 129, a small amount of fuel, referred to as injector leak-off fuel, leaks past a plunger from a region of high pressure to a region of low pressure. Injector leak-off fuel is confined by a plurality of o-rings 170 to an injector leak-off passageway between the fuel injector 129 and the cylinder head 105. The leak-off fuel flows into the injector leak-off passageway 136 between the side feed tube 144 and the cylinder head 105, and then it flows out of the cylinder head 105 and into passages in the rocker shaft carrier housing (not shown). The o-ring 143 and the plurality of o-rings 170 prevent the injector leak-off fuel from leaking out of the cylinder head engine 106.

The coupler 138 comprises a nut 154 threaded into the cylinder head 105. Although a portion of the nut 154 is shown as having six sides, in other embodiments it could have greater or fewer sides. The coupler 138 may further comprise a sleeve 156, wherein the injection line 124 extends through the sleeve 156 and the nut 154. The sleeve 156 comprises a slot 159 extending radially through the sleeve 156. The slot 159 is included in the fuel leak passageway 142 and fluidly connects the second portion 155 and the third portion 157 of the fuel leak passageway 142.

The movement of the cap 130 away from the seated position to the unseated position is caused by the first sealed connection 180 between the cap 130 and the injection line 124 being broken, such as via a slight gap, though not necessarily a circumferential gap. In such a case, it may be that an interference fit between the cap 130 and the injection line 124 is broken. Alternatively, the movement of the cap 130 away from the seated position to the unseated position is caused by the second sealed connection 178 between the cap 130 and the coupler 138 being broken. Or more specifically, the movement from the seated position to the unseated position is caused by the second sealed connection 178 between the cap 130 and the nut 154 being broken. In one embodiment, the cap 130 is a fluoroelastomer cap, so as to give the cap 130 elastic properties for allowing the cap 130 to move between the seated position and the unseated position, as just described.

The cap 130 slidably engages with the coupler 138 and seats against the nut 154 when in the seated position. Further, the coupler 138 comprises a circumferential groove 126, and the cap 130 slidably engages with the circumferential groove 126. The cap 130 comprises a circumferential cap lip 132 extending radially inwards towards the injection line 124. The coupler 138 comprises a face surface 145, wherein the circumferential cap lip 132 at least partially engages with the face surface 145 when the cap 130 is in the seated position.

The cap 130 comprises an inner diametrical portion 150 and extending therefrom is an outer diametrical portion 152. The inner diametrical portion 150 cooperates with the injection line 124 so as to form the first sealed connection 180, while the outer diametrical portion 152 cooperates with the coupler 138 so as to form the second sealed connection 178. The outer diametrical portion 152 comprises the circumferential cap lip 132 extending radially inwards and towards the injection line 124, and the coupler 138 comprises a circumferential coupler lip 140 that extends radially outwards and away from the injection line 124. The circumferential cap lip 132 and the coupler lip 140 engage with one another when the cap 130 is in the unseated seated position, and further, the circumferential cap lip 132 and the coupler lip 140 at least partially engage with one another when the cap 130 is in the unseated position. The coupler 138 comprises a circumferential groove 126, which the coupler lip 140 extends radially away from. The cap 130 slidably engages with the circumferential groove 126.

Figure 2:
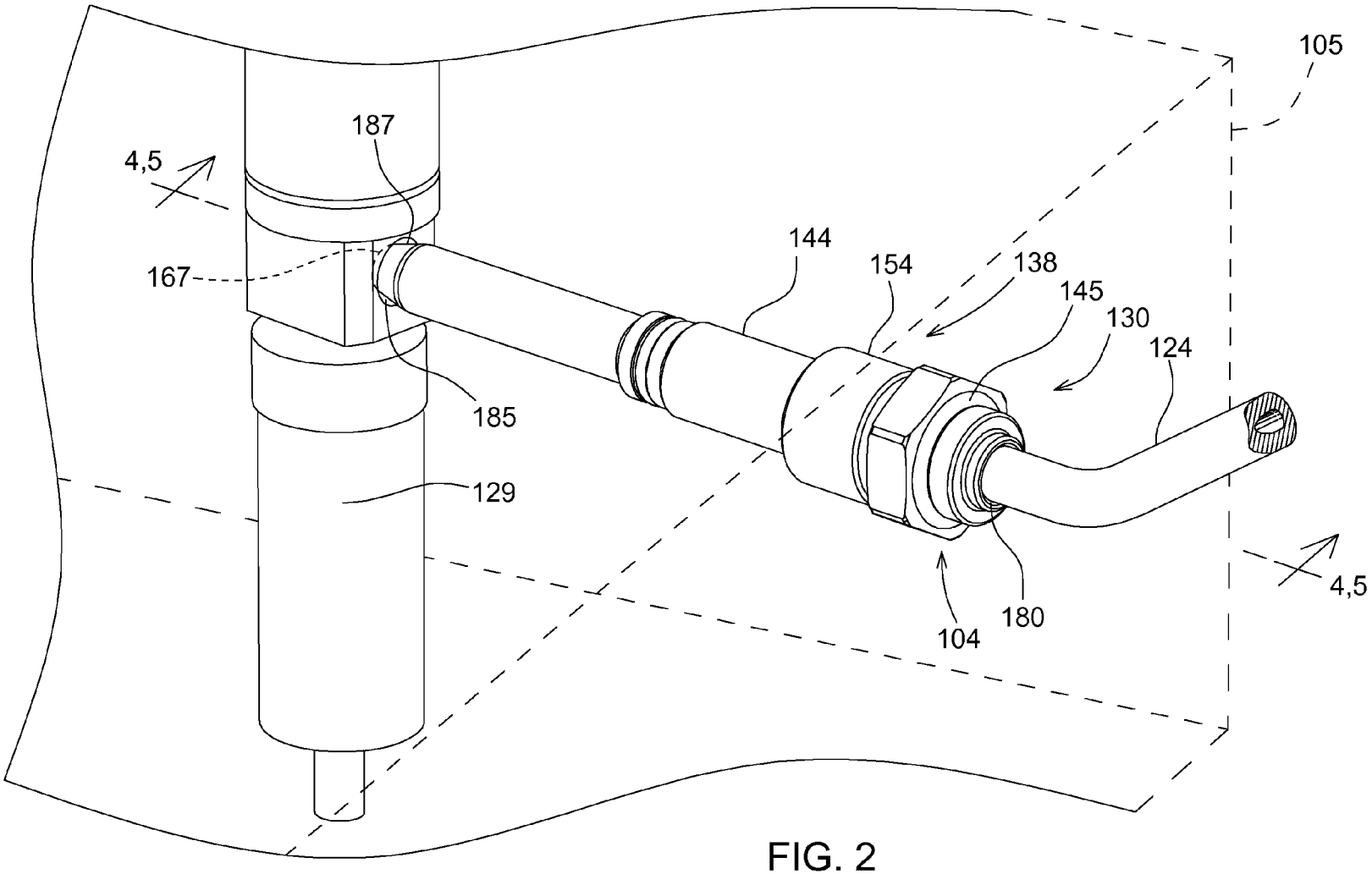
FIG. 2 is a perspective view of the sealing system, showing a side feed tube, a fuel injection line, and a cap.
Figure 6:
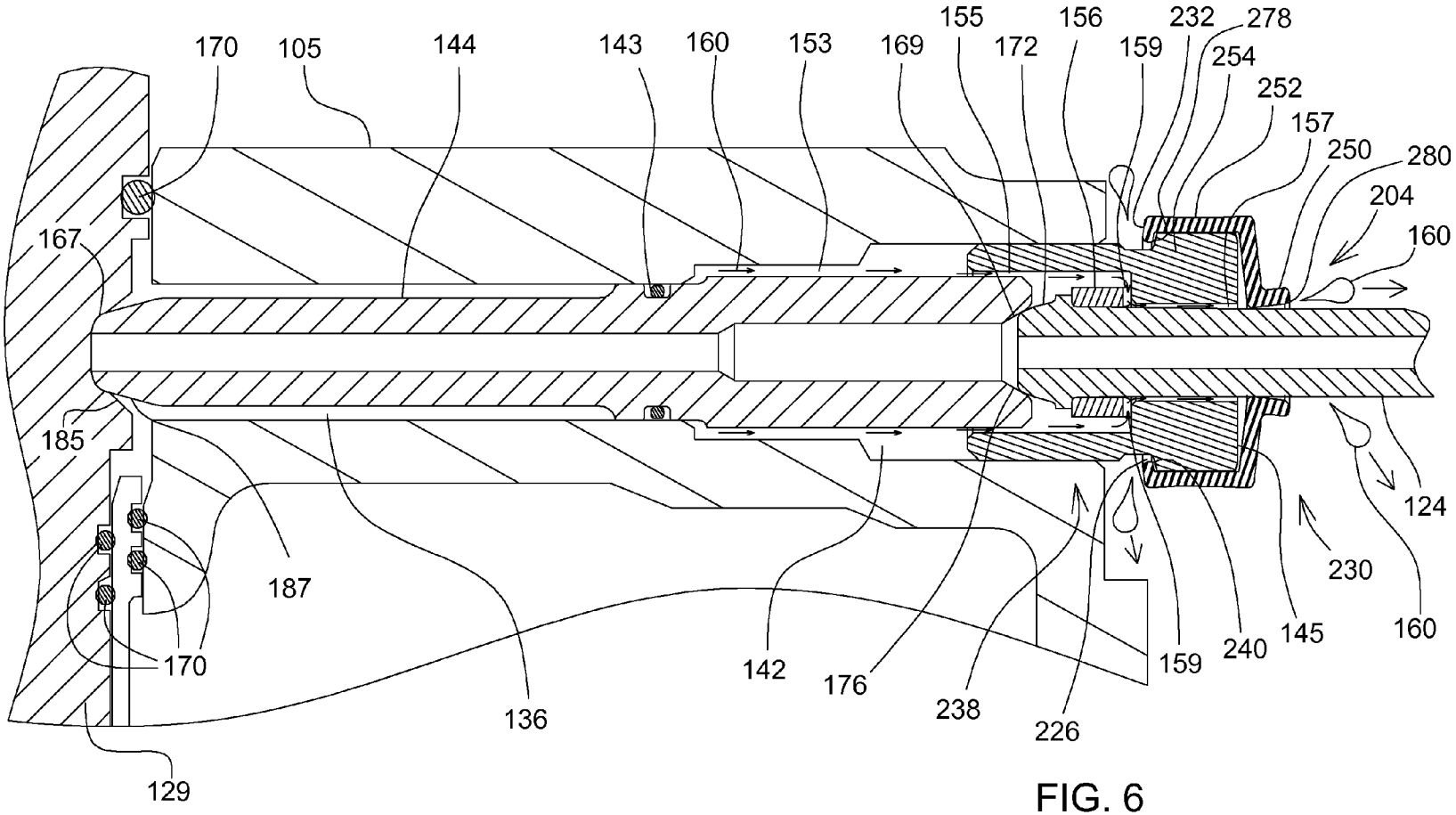
FIG. 6 is a sectional view of a second sealing system taken along lines similar to lines 5-5 of FIG. 2, showing a second cap in an unseated position, allowing the egress of fuel to the outside environment.

Referring to FIG. 6, there is shown a sectional view of a second sealing system 204 taken along lines similar to lines 5-5 of FIG. 2, showing a second cap 230 in an unseated position, allowing the egress of fuel to the outside environment. A difference between the sealing system 104 and the second sealing system 204 is that the second sealing system 204 comprises the second cap 230 overlapping a second nut 254. Still, the second sealing system 204 has several components similar in structure and function as the sealing system 104, as indicated by the use of identical reference numerals where applicable.

The injection line 124 extends through the cap 230, and the cap 230 yieldably urges itself into a seated position in which the cap 230 establishes a first sealed connection 280 with the injection line 124 and establishes a second sealed connection 278 with the coupler 238, so as to block ingress of moisture into the fuel leak passageway 142. Additionally, the cap 230 allows movement of itself away from the seated position to an unseated position in response to a pressurized leaked fuel, in the fuel leak passageway 142, so as to allow the pressurized leaked fuel to flow out thereof. The unseated position may be a position where the cap 230 is unseated only partially about a circumference thereof, or a position where the cap is unseated about an entire circumference thereof.

The cap 230 comprises an inner diametrical portion 250 and extending therefrom is an outer diametrical portion 252. The inner diametrical portion 250 cooperates with the injection line 124 so as to form the first sealed connection 280, while the outer diametrical portion 252 cooperates with the coupler 238 so as to form the second sealed connection 278. The outer diametrical portion 252 comprises the circumferential cap lip 232 extending radially inwards and towards the injection line 124, and the coupler 238 comprises a circumferential coupler lip 240 that extends radially outwards and away from the injection line 124. The cap lip 232 and the coupler lip 240 engage with one another when the cap 230 is in the unseated position, and further, the circumferential cap lip 232 and the coupler lip 240 at least partially engage with one another when the cap 230 is in the unseated position. The coupler 238 comprises a circumferential groove 226, which the coupler lip 240 extends radially away from. The cap 230 slidably engages with the circumferential groove 226.

While the disclosure has been illustrated and described in detail in the drawings and foregoing description, such illustration and description is to be considered as exemplary and not restrictive in character, it being understood that illustrative embodiments have been shown and described and that all changes and modifications that come within the spirit of the disclosure are desired to be protected. It will be noted that alternative embodiments of the present disclosure may not include all of the features described yet still benefit from at least some of the advantages of such features. Those of ordinary skill in the art may readily devise their own implementations that incorporate one or more of the features of the present disclosure and fall within the spirit and scope of the present invention as defined by the appended claims.

The invention claimed is:

1. A sealing system, comprising:

a cylinder head;

a coupler positioned in the cylinder head;

a fuel injection line extending into the coupler so as to at least partially define a fuel leak passageway therebetween; and a cap, wherein the fuel injection line extends through the cap, the cap yieldably urges itself into a seated position in which the cap establishes a first sealed connection with the fuel injection line and establishes a second sealed connection with the coupler, so as to block ingress of moisture into the fuel leak passageway, the cap is adapted to move from the seated position to an unseated position in response to a pressurized leaked fuel, in the fuel leak passageway, so as to allow the pressurized leaked fuel to flow out of the fuel leak passageway, and the movement of the cap away from the seated position to the unseated position is caused by the first sealed connection between the cap and the fuel infection line being broken.

2. The sealing system of claim 1, wherein the coupler further comprises a circumferential groove, and the cap slidably engages with the circumferential groove.

3. The sealing system of claim 1, wherein the cap further comprises a circumferential cap lip extending radially inwards towards the injection line, the coupler further comprises a face surface, and the circumferential cap lip at least partially engages with the face surface when the cap is in the seated position.

4. The sealing system of claim 1, wherein the cap yieldably establishes a sealed connection between the cap and the coupler so as to establish the second sealed connection.

5. The sealing system of claim 1, wherein the coupler further comprises a nut, and the cap yieldably establishes a sealed connection with the nut so as to establish the second sealed connection.

6. The sealing system of claim 1, wherein the coupler further comprises a sleeve and a nut, the fuel injection line extends through the sleeve and the nut, and the sleeve further comprises a slot extending radially through the sleeve and included in the fuel leak passageway.

7. The sealing system of claim 1, wherein the cap and the fuel injection line form an interference fit.

8. The sealing system of claim 1, wherein the cap is a fluoroelastomer cap, so as to give the cap elastic properties for allowing the cap to move between the seated position and the unseated position.

9. The sealing system of claim 1, wherein the cap further comprises an inner diametrical portion and extending therefrom is an outer diametrical portion, the inner diametrical portion cooperates with the fuel injection line so as to form the first sealed connection, and the outer diametrical portion cooperates with the coupler so as to form the second sealed connection.

10. The sealing system of claim 9, wherein the outer diametrical portion further comprises a circumferential cap lip extending radially inwards towards the fuel injection line, and the coupler further comprises a circumferential coupler lip that extends radially outwards away from the fuel injection line, the circumferential cap lip and the circumferential coupler lip engage with one another when the cap is in the unseated position.

11. The sealing system of claim 1, wherein the cap further comprises a circumferential cap lip extending radially inwards towards the fuel injection line, the coupler further comprises a circumferential coupler lip that extends radially outwards from the fuel injection line, and the circumferential cap lip and the circumferential coupler lip at least partially engage with one another when the cap is in the unseated position.

12. The sealing system of claim 11, wherein the coupler further comprises a circumferential groove, the cap slidably engages with the circumferential groove, and the circumferential coupler lip extends radially away from the circumferential groove.

13. The sealing system of claim 1, further comprising a side feed tube positioned in the cylinder head and positioned downstream of the fuel injection line, the cylinder head and the side feed tube defining a first portion of the fuel leak passageway therebetween, and the first portion being configured to allow the pressurized leaked fuel to flow therethrough and past the cap when the cap is in the unseated position.

14. The sealing system of claim 13, wherein the pressurized leaked fuel flowing through the fuel leak passageway emanates from a junction between the side feed tube and the fuel injection line.

15. The sealing system of claim 13, wherein the side feed tube and the coupler define a second portion of the fuel leak passageway therebetween, the first portion is positioned upstream of the second portion, and the second portion is configured to allow the pressurized leaked fuel to flow therethrough and past the cap when the cap is in the unseated position.

16. The sealing system of claim 15, wherein the fuel injection line and the coupler define a third portion of the fuel leak passageway therebetween, the second portion is positioned upstream of the third portion, and the third portion is configured to allow the pressurized leaked fuel to flow therethrough and past the cap when the cap is in the unseated position.

17. The sealing system of claim 16, wherein the coupler further comprises a sleeve and a nut, the fuel injection line extends through the sleeve and the nut, the sleeve further comprises a slot extending radially through the sleeve and included in the fuel leak passageway, and the slot fluidly connects the second portion and the third portion of the fuel leak passageway.

* * * * *